US011664001B2

(12) United States Patent
Tani

(10) Patent No.: US 11,664,001 B2
(45) Date of Patent: May 30, 2023

(54) NOISE REDUCTION DEVICE, VEHICLE, AND NOISE REDUCTION METHOD

(71) Applicant: Panasonic Intellectual Property Management Co., Ltd., Osaka (JP)

(72) Inventor: Mitsuhiro Tani, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 17/574,234

(22) Filed: Jan. 12, 2022

(65) Prior Publication Data

US 2022/0230617 A1 Jul. 21, 2022

(30) Foreign Application Priority Data

Jan. 14, 2021 (JP) ..... JP2021-004545

(51) Int. Cl.
*G10K 11/178* (2006.01)

(52) U.S. Cl.
CPC .. *G10K 11/17854* (2018.01); *G10K 11/17823* (2018.01); *G10K 11/17881* (2018.01); *G10K 11/17825* (2018.01); *G10K 2210/1282* (2013.01); *G10K 2210/3026* (2013.01); *G10K 2210/3027* (2013.01); *G10K 2210/3028* (2013.01); *G10K 2210/3036* (2013.01)

(58) Field of Classification Search
CPC ..... G10K 11/17854; G10K 11/17823; G10K 11/17881; G10K 11/17825
See application file for complete search history.

(56) References Cited

U.S. PATENT DOCUMENTS

| | | | | |
|---|---|---|---|---|
| 10,347,236 | B1 | 7/2019 | Bastyr et al. | |
| 11,232,778 | B1 * | 1/2022 | Farahbakhsh .... | G10K 11/17879 |
| 2015/0063581 | A1 | 3/2015 | Tani et al. | |
| 2020/0365133 | A1 * | 11/2020 | Pignier ..... | G10K 11/17833 |
| 2022/0180852 | A1 * | 6/2022 | Bou Daher ..... | H04R 3/00 |

FOREIGN PATENT DOCUMENTS

| | | |
|---|---|---|
| JP | 2019-151323 | 9/2019 |
| WO | 2014/006846 | 1/2014 |

* cited by examiner

*Primary Examiner* — Ping Lee
(74) *Attorney, Agent, or Firm* — Greenblum & Bernstein, P.L.C.

(57) ABSTRACT

An active noise reduction device includes: an adaptive filter that generates a cancelling signal by applying an adaptive filter to a reference signal that has a correlation with noise in a space in an automobile, the cancelling signal being used to output a cancelling sound for reducing the noise; and a filter coefficient updater that calculates a coefficient of the adaptive filter based on a predetermined update equation. At a first timing at which the output of the cancelling sound is started, the filter coefficient updater uses a first coefficient as an initial value of the update equation, the first coefficient being the coefficient of the adaptive filter calculated by the filter coefficient updater at a second timing that is prior to the first timing.

18 Claims, 6 Drawing Sheets

NOISE REDUCTION DEVICE, VEHICLE, AND NOISE REDUCTION METHOD

CROSS REFERENCE TO RELATED APPLICATION

The present application is based on and claims priority of Japanese Patent Application No. 2021-4545 filed on Jan. 14, 2021.

FIELD

The present disclosure relates to an active noise reduction device that actively reduces noise by interfering a cancelling sound with the noise, a vehicle that includes the active noise reduction device, and an active noise reduction method.

BACKGROUND

Conventionally, an active noise reduction device is known that actively reduces noise by outputting a cancelling sound for cancelling out the noise from a cancelling sound source by using a reference signal that has a correlation with the noise and an error signal that is based on a residual sound generated through the interference between the noise and the cancelling sound in a predetermined space (see, for example, Patent Literature (PTL) 1). The active noise reduction device generates a cancelling signal for outputting the cancelling sound by using an adaptive filter so as to minimize the sum of squares of the error signal.

CITATION LIST

Patent Literature

PTL 1: WO 2014/006846

SUMMARY

However, the active noise reduction device according to PTL 1 described above can be improved upon.

In view of this, the present disclosure provides an active noise reduction device capable of improving upon the above related art.

An active noise reduction device according to one aspect of the present disclosure includes: a reference signal inputter to which a reference signal that has a correlation with noise in a space in a vehicle is input, the reference signal being output by a reference signal source attached to the vehicle; an adaptive filter that generates a cancelling signal by applying an adaptive filter to the reference signal that is input to the reference signal inputter, the cancelling signal being used to output a cancelling sound for reducing the noise; and a filter coefficient updater that calculates a coefficient of the adaptive filter based on a predetermined update equation. At a first timing at which the output of the cancelling sound is started, the filter coefficient updater uses a first coefficient as an initial value of the update equation, the first coefficient being the coefficient of the adaptive filter calculated by the filter coefficient updater at a second timing that is prior to the first timing.

The active noise reduction device according to one aspect of the present disclosure is capable of improving upon the above related art

BRIEF DESCRIPTION OF DRAWINGS

These and other advantages and features of the present disclosure will become apparent from the following description thereof taken in conjunction with the accompanying drawings that illustrate a specific embodiment of the present disclosure.

DESCRIPTION OF EMBODIMENT

Figure 1:
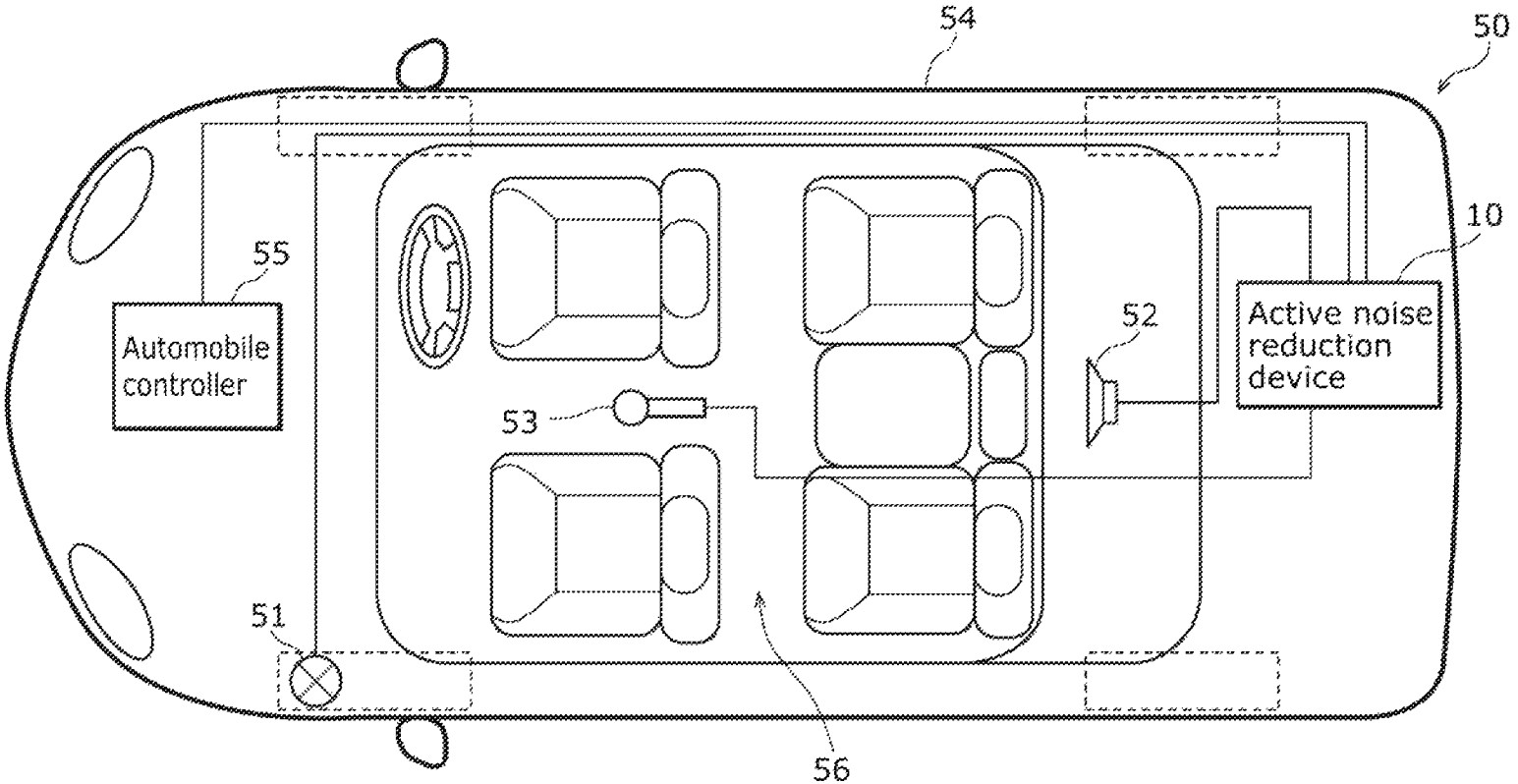
FIG. 1 is a schematic diagram of an automobile according to an embodiment as viewed from above.

Hereinafter, an embodiment will be described specifically with reference to the drawings. The embodiment described below shows a generic or specific example of the present disclosure. The numerical values, shapes, materials, structural elements, the arrangement and connection of the structural elements, steps, the order of the steps, and the like shown in the following embodiment are merely examples, and therefore are not intended to limit the scope of the present disclosure. Also, among the structural elements described in the following embodiment, structural elements not recited in any one of the independent claims are described as arbitrary structural elements.

Also, the diagrams are schematic representations, and thus are not necessarily true to scale. Also, in the diagrams, structural elements that are substantially the same are given the same reference numerals, and a redundant description may be omitted or simplified.

The term "timing" used in the embodiment given below is not used in a strict sense. For example, the expression "the timing at which the output of the cancelling sound is started" refers to a concept that has a certain time width and in which it is considered that the output of the cancelling sound is substantially started, and thus it does not mean a certain moment. The same applies to the timing at which the power source of the automobile is turned off, the timing at which the automobile stops moving, the timing at which the automobile resumes moving, and the like.

Embodiment

[Configuration of Automobile]

Hereinafter, an automobile according to an embodiment, and an active noise reduction device that is mounted on the automobile will be described. First, the automobile according to the embodiment will be described. FIG. 1 is a schematic diagram of the automobile according to the embodiment as viewed from above.

Automobile 50 is an example of a vehicle, and includes active noise reduction device 10 according to the embodiment, reference signal source 51, cancelling sound source 52, error signal source 53, automobile main body 54, and automobile controller 55. Automobile 50 is specifically a passenger car, but the present disclosure is not limited thereto.

Reference signal source 51 is a transducer that outputs a reference signal that has a correlation with noise in space 56 of the cabin of automobile 50. In the present embodiment, reference signal source 51 is an acceleration sensor, and is provided outside space 56. Specifically, reference signal source 51 is attached to the subframe near the left front wheel (or, the wheelhouse of the left front wheel). However, there is no particular limitation on the attachment position of reference signal source 51. In the case where reference signal source 51 is an acceleration sensor, active noise reduction device 10 can reduce a roadway noise component that is included in the noise in space 56. The roadway noise has a complex propagation path, and it is therefore advantageous to provide acceleration sensors at a plurality of locations. Here, reference signal source 51 may be a microphone.

Cancelling sound source 52 outputs a cancelling sound to space 56 by using a cancelling signal. In the present embodiment, cancelling sound source 52 is a speaker, but the cancelling sound may be output as a result of one (for example, sunroof or the like) of the structural bodies of automobile 50 being vibrated by a driving mechanism such as an actuator. Also, in active noise reduction device 10, a plurality of cancelling sound sources 52 may be used, and there is no particular limitation on the attachment positions of cancelling sound sources 52.

Error signal source 53 detects a residual sound generated by interference between the noise and the cancelling sound in space 56, and outputs an error signal based on the residual sound. It is desirable that error signal source 53 is a transducer such as a microphone and is disposed in space 56 such as a headliner. Here, automobile 50 may include a plurality of error signal sources 53.

Automobile main body 54 is a structural body that includes a chassis, a body, and the like of automobile 50. Automobile main body 54 forms space 56 (the space in the automobile cabin) in which cancelling sound source 52 and error signal source 53 are disposed.

Automobile controller 55 controls (drives) automobile 50 based on operations and the like of the driver of automobile 50. Also, automobile controller 55 outputs an automobile state signal that indicates the state of automobile 50 to active noise reduction device 10. Automobile controller 55 is, for example, an ECU (Electronic Control Unit), and is specifically implemented by using a processor, a microcomputer, a dedicated circuit, or the like. Automobile controller 55 may be implemented by a combination of two or more of a processor, a microprocessor, and a dedicated circuit.

[Configuration of Active Noise Reduction Device]

Figure 2:
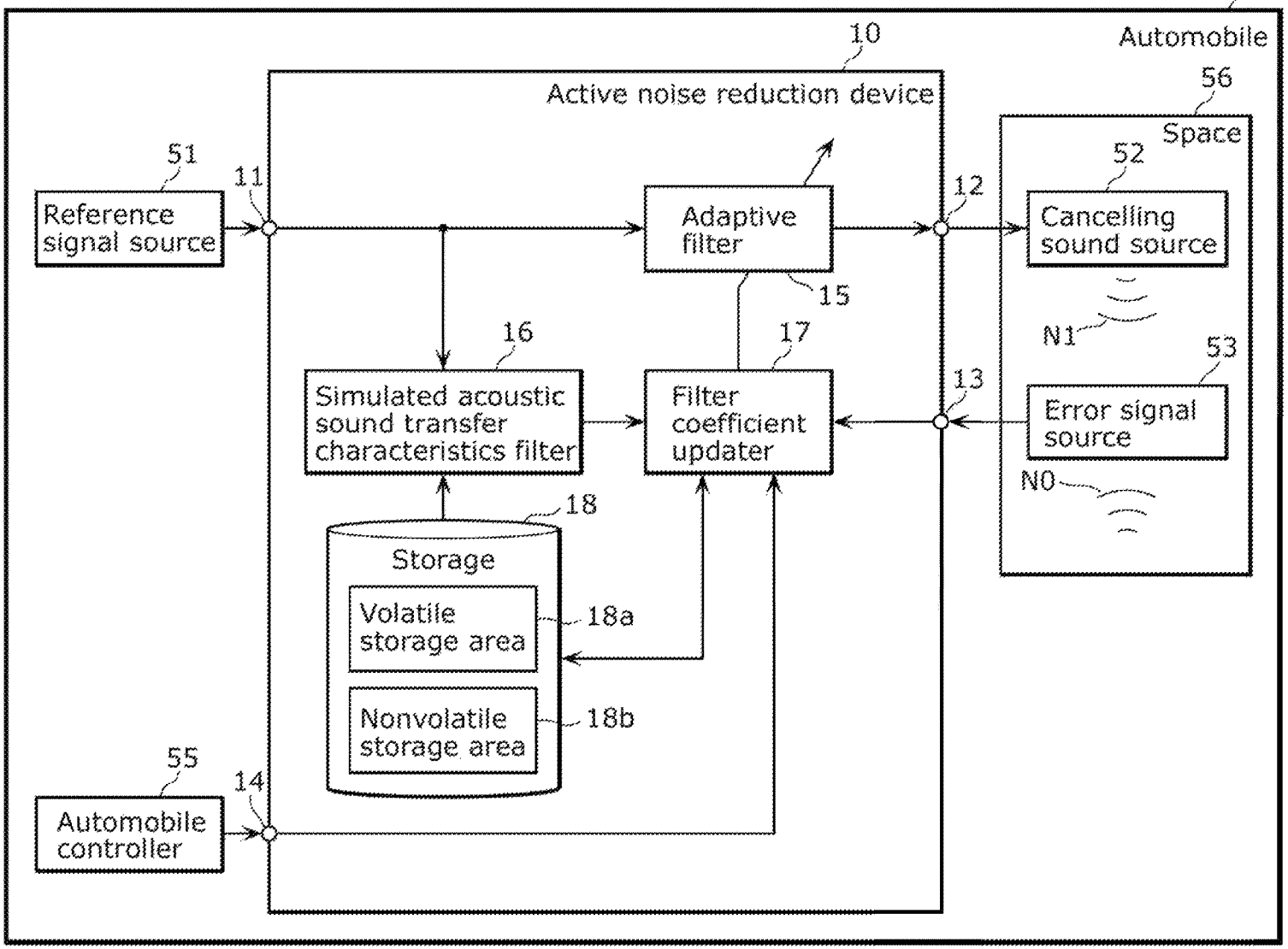
FIG. 2 is a block diagram showing a functional configuration of an active noise reduction device according to the embodiment.

Next, a configuration of active noise reduction device 10 will be described. FIG. 2 is a block diagram showing a functional configuration of active noise reduction device 10.

As shown in FIG. 2, active noise reduction device 10 includes reference signal input terminal 11, cancelling signal output terminal 12, error signal input terminal 13, automobile state signal input terminal 14, adaptive filter 15, simulated acoustic sound transfer characteristics filter 16, filter coefficient updater 17, and storage 18. Adaptive filter 15, simulated acoustic sound transfer characteristics filter 16, and filter coefficient updater 17 are implemented by, for example, a processor such as a DSP (Digital Signal Processor) or a microcomputer executing software. Adaptive filter 15, simulated acoustic sound transfer characteristics filter 16, and filter coefficient updater 17 may be implemented by using hardware such as circuits. Also, some of adaptive filter 15, simulated acoustic sound transfer characteristics filter 16, and filter coefficient updater 17 may be implemented by using software, and the remaining ones may be implemented by using hardware.

[Basic Operation]

Figure 3:
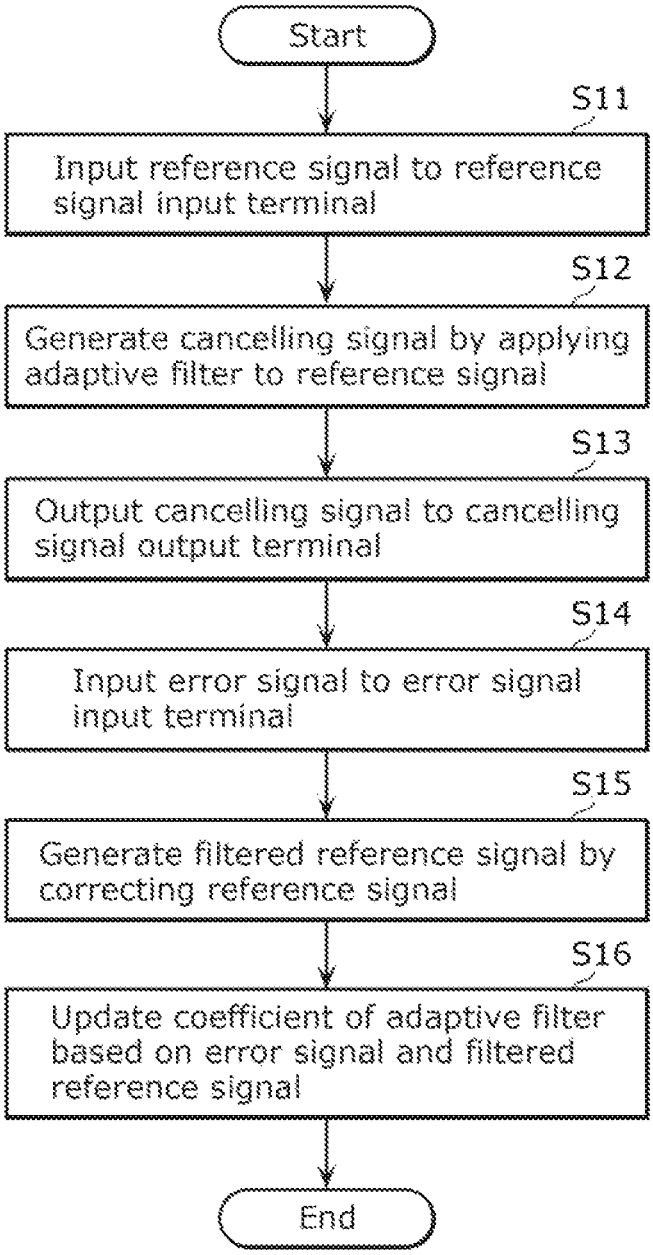
FIG. 3 is a flowchart of a basic operation performed by the active noise reduction device according to the embodiment.

As described above, active noise reduction device 10 performs a noise reduction operation. First, a basic operation performed by active noise reduction device 10 will be described with reference to FIGS. 2 and 3. FIG. 3 is a flowchart of the basic operation performed by active noise reduction device 10.

First, a reference signal that has a correlation with noise NO is input from reference signal source 51 to reference signal input terminal 11 (S11). Reference signal input terminal 11 is an example of a reference signal inputter, and is specifically a terminal made of a metal or the like.

The reference signal input to reference signal input terminal 11 is output to adaptive filter 15 and simulated acoustic sound transfer characteristics filter 16. Adaptive filter 15 generates a cancelling signal by applying (convolving) an adaptive filter to the reference signal input to reference signal input terminal 11 (S12). Adaptive filter 15 is implemented by using a so-called FIR filter or IIR filter. Adaptive filter 15 outputs the generated cancelling signal to cancelling signal output terminal 12. The cancelling signal is used to output cancelling sound N1 for reducing noise NO, and is output to cancelling signal output terminal 12 (S13).

Cancelling signal output terminal 12 is an example of a cancelling signal outputter, and is a terminal made of a metal or the like. The cancelling signal generated by adaptive filter 15 is output to cancelling signal output terminal 12.

Cancelling signal output terminal 12 is connected to cancelling sound source 52. Accordingly, the cancelling signal is output to cancelling sound source 52 via cancelling signal output terminal 12. Cancelling sound source 52 outputs cancelling sound N1 based on the cancelling signal.

Error signal source 53 detects a residual sound generated by interference between noise NO and cancelling sound N1 generated by cancelling sound source 52 to correspond to the cancelling signal, and outputs an error signal that corresponds to the residual sound. As a result, the error signal is input to error signal input terminal 13 (S14). Error signal input terminal 13 is an example of an error signal inputter, and is a terminal made of a metal or the like.

Next, simulated acoustic sound transfer characteristics filter 16 generates a first filtered reference signal by correcting the reference signal by using simulated transfer characteristics obtained by simulating acoustic sound transfer characteristics from cancelling signal output terminal 12 to error signal input terminal 13 (S15). In other words, the simulated transfer characteristics are obtained by simulating acoustic sound transfer characteristics from the position of cancelling sound source 52 to the position of error signal source 53 (or in other words, the acoustic sound transfer characteristics in space 56). The simulated transfer characteristics are measured in, for example, in space 56 and stored in storage 18 in advance. The simulated transfer characteristics may be determined by using an algorithm that does not use predetermined values.

Storage 18 is a storage device that stores the simulated transfer characteristics. Storage 18 is specifically implemented by using a semiconductor memory or the like. In the case where adaptive filter 15, simulated acoustic sound transfer characteristics filter 16, and filter coefficient updater 17 are implemented by using a processor such as a DSP, a control program that is executed by the processor is also stored in storage 18. Storage 18 may also store other parameters that are used in signal processing operations performed by adaptive filter 15, simulated acoustic sound transfer characteristics filter 16, and filter coefficient updater 17. Storage 18 includes volatile storage area 18*a* and nonvolatile storage area 18*b* as the areas in which adaptive filter coefficients, which will be described later, are stored.

Filter coefficient updater 17 sequentially updates adaptive filter coefficient W based on the error signal and the generated first filtered reference signal (S16).

Specifically, filter coefficient updater 17 calculates adaptive filter coefficient W by using an LMS (Least Mean Square) method so as to minimize the sum of squares of the error signal, and outputs the calculated adaptive filter coefficient to adaptive filter 15. Also, filter coefficient updater 17 sequentially updates the adaptive filter coefficient. Adaptive filter coefficient W is expressed by Equation 1 given below, where the vector of the error signal is represented by e and the vector of the first filtered reference signal is represented by R. Here, n is a natural number, and represents the n-th sample in sampling period Ts. μ is a scalar quantity, and is a step size parameter for determining the update amount of adaptive filter coefficient W per sample.

[Math. 1]

$$W(n+1)=W(n)-\mu\times e(n)\times R(n) \quad \text{(Equation 1)}$$

Filter coefficient updater 17 may update adaptive filter coefficient W by using a method other than the LMS method.

[Operation for Achieving Early Adaptation of Cancelling Sound]

In an active noise reduction device, there is a need to shorten the time required from when the output of a cancelling sound is started to when the effect of reducing noise is obtained. In general, in active noise reduction device 10, at a timing (hereinafter also referred to as "first timing") at which the output of cancelling sound N1 is started for the first time, the initial value (or in other words, W(0)) of adaptive filter coefficient W is set to 0, and the calculation (update) of adaptive filter coefficient W based on a predetermined update equation (Equation 1 given above) is started. In this case, it takes time to obtain the effect of reducing noise NO by using cancelling sound N1.

Figure 4:
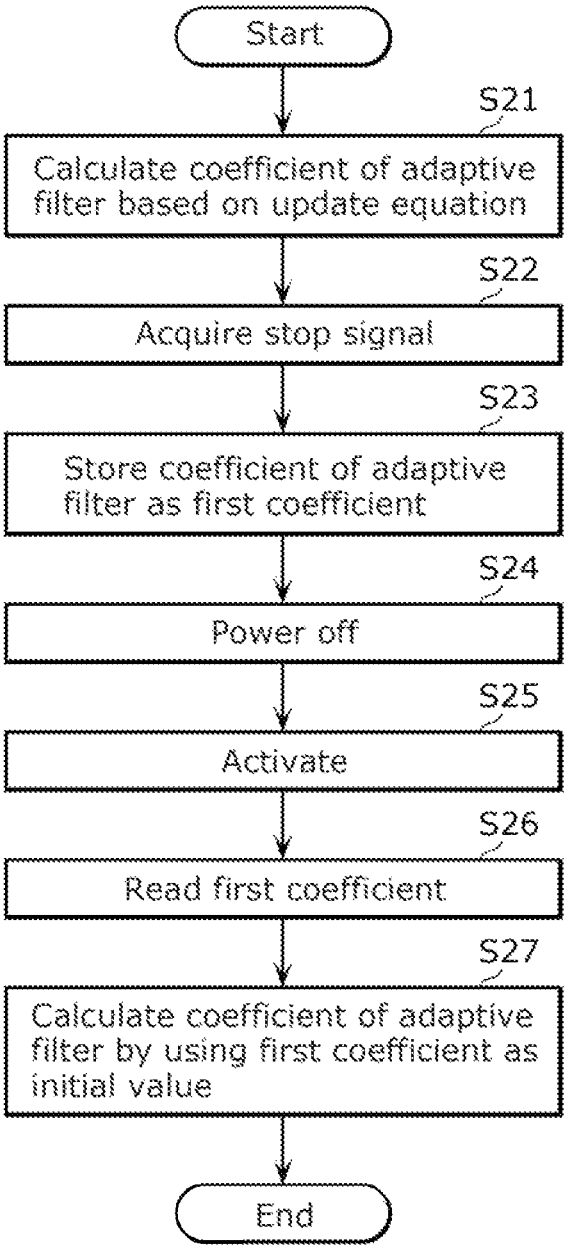
FIG. 4 is a flowchart of an operation for achieving early adaptation of a cancelling sound.

To address this, filter coefficient updater 17 achieves an early adaptation of cancelling sound N1 to noise NO by storing adaptive filter coefficient W that was calculated by filter coefficient updater 17 in nonvolatile storage area 18*b*, and using adaptive filter coefficient W as the initial value. FIG. 4 is a flowchart of an operation for achieving the early adaptation of cancelling sound N1.

While automobile 50 is driving (or in other words, moving), filter coefficient updater 17 calculates adaptive filter coefficient W based on the update equation (S21). At this time, adaptive filter coefficient W of the previous sampling is stored in volatile storage area 18*a*.

When active noise control device 10 is turned off such as when the ignition power supply of automobile 50 is turned off, filter coefficient updater 17 acquires a stop signal from automobile controller 55 via automobile state signal input terminal 14 (S22). The stop signal is, in other words, a signal for notifying that automobile 50 has stopped.

In response to acquiring the stop signal, filter coefficient updater 17 stores adaptive filter coefficient W calculated by filter coefficient updater 17 at a most recent timing (hereinafter also referred to as "second timing") in nonvolatile storage area 18*b* as a first coefficient (S23). More specifically, filter coefficient updater 17 reads adaptive filter coefficient W calculated at the most recent timing and stored in volatile storage area 18*a*, and stores adaptive filter coefficient W in nonvolatile storage area 18*b* as a first coefficient.

As used herein, the term "adaptive filter coefficient W calculated at the most recent timing" is not used in a strict sense, and may be, for example, a substantially final value of adaptive filter coefficient W. Adaptive filter coefficient W calculated at the most recent timing may be the average value, median value, maximum value, or the like of adaptive filter coefficient W calculated in the most recent predetermined period. After step S23, the supply of power from the battery of automobile 50 to active noise reduction device 10 is turned off, and thus active noise reduction device 10 is transitioned to a power off state (S24).

After that, when the engine of automobile 50 is turned on, active noise reduction device 10 receives a supply of power from the battery of automobile 50 and is activated (S25), and then starts outputting cancelling sound N1. At this time, filter coefficient updater 17 reads the first coefficient that was stored in nonvolatile storage area 18*b* in step S23 (S26), and calculates adaptive filter coefficient W based on the update equation by using the read first coefficient as the initial value (S27).

As described above, filter coefficient updater 17 uses the first coefficient as the initial value of the updated equation at a first timing before the output of cancelling sound N1 is started, the first coefficient being adaptive filter coefficient W calculated by filter coefficient updater 17 at a second timing that is prior to the first timing. By doing so, active noise reduction device 10 can shorten the time required to obtain the effect of reducing noise NO by using cancelling sound N1.

Also, in the example shown in FIG. 4, the second timing is a timing at which automobile 50 stops driving, and the first timing is, for example, a timing that is immediately after automobile 50 stops driving and at which automobile 50 starts driving again. In the case where active noise reduction device 10 is designed to reduce roadway noise, it is highly likely that automobile 50 is driving the same type of roadway when automobile 50 stops driving and then resumes driving. That is, it is highly likely that adaptive filter coefficient W obtained when automobile 50 stops driving is also effective when automobile 50 resumes driving. Accordingly, the configuration of the operation of example 1 is considered to be particularly effective in active noise reduction device 10 that is designed to reduce roadway noise.

In the example shown in FIG. 4, filter coefficient updater 17 stores the first coefficient in nonvolatile storage area 18*b* in response to acquiring a stop signal (or in other words, when automobile 50 stops driving). However, this configuration is not a requirement. For example, filter coefficient updater 17 may regularly store the first coefficient in nonvolatile storage area 18*b* while automobile 50 is driving, irrespective of the stop signal. Also, the first coefficient may be stored in nonvolatile storage area 18*b* in response to a signal other than the stop signal being acquired. It is sufficient that the first coefficient is stored at the second timing that is prior to the first timing.

[Correction of First Coefficient]

In the case where the state of automobile 50 at the second timing at which the first coefficient is stored and the state of automobile 50 at the first timing at which the first coefficient is read are significantly different, when the first coefficient is used as the initial value, the first coefficient may not be appropriate for noise NO that is the current noise, and thus cancelling sound N1 output at the first timing may be transformed into an abnormal sound.

To address this, at the first timing, filter coefficient updater 17 may use a corrected first coefficient as the initial value of the update equation instead of the first coefficient, the corrected first coefficient being obtained by multiplying the first coefficient by a correction coefficient that is greater than 0 and less than 1. By doing so, active noise reduction device 10 can shorten the time required to obtain the effect of reducing noise N0 by using cancelling sound N1 while preventing cancelling sound N1 from being transformed into an abnormal sound.

Figure 5:
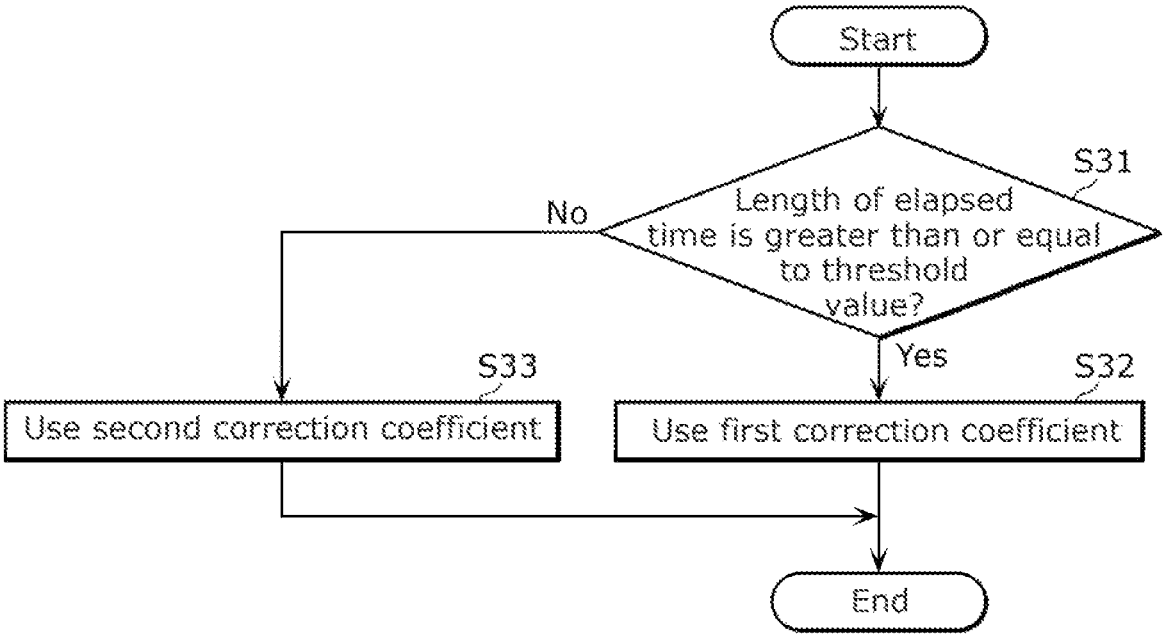
FIG. 5 is a flowchart of a correction coefficient determining operation of example 1.

The correction coefficient is, for example, a fixed value determined in advance, but may be determined according to the length of the period from the second timing to the first timing. FIG. 5 is a flowchart of a correction coefficient determining operation of example 1 performed in this case.

Filter coefficient updater 17 stores the second timing in storage 18, and determines, at the first timing, whether the length of the period from the second timing to the first timing is greater than or equal to a threshold value (S31).

If it is determined that the length of the period (elapsed time) from the second timing to the first timing is greater than or equal to the threshold value (Yes in S31), filter coefficient updater 17 corrects the first coefficient by using a first correction coefficient (S32). On the other hand, if it is determined that the length of the period from the second timing to the first timing is less than the threshold value (No in S31), filter coefficient updater 17 corrects the first coefficient by using a second correction coefficient that is greater than the first correction coefficient (S33). The first correction coefficient and the second correction coefficient are both values that are greater than 0 and less than 1.

As described above, filter coefficient updater 17 determines the correction coefficient to a smaller value as the length of the period from the second timing to the first timing is longer. In general, as the length of the period from the second timing to the first timing is longer, it is more likely that the state of automobile 50 varies. With active noise reduction device 10, by setting the correction coefficient to be a smaller value as the length of the period from the second timing to the first timing is longer, it is possible to prevent cancelling sound N1 from being transformed into an abnormal sound.

Figure 6:
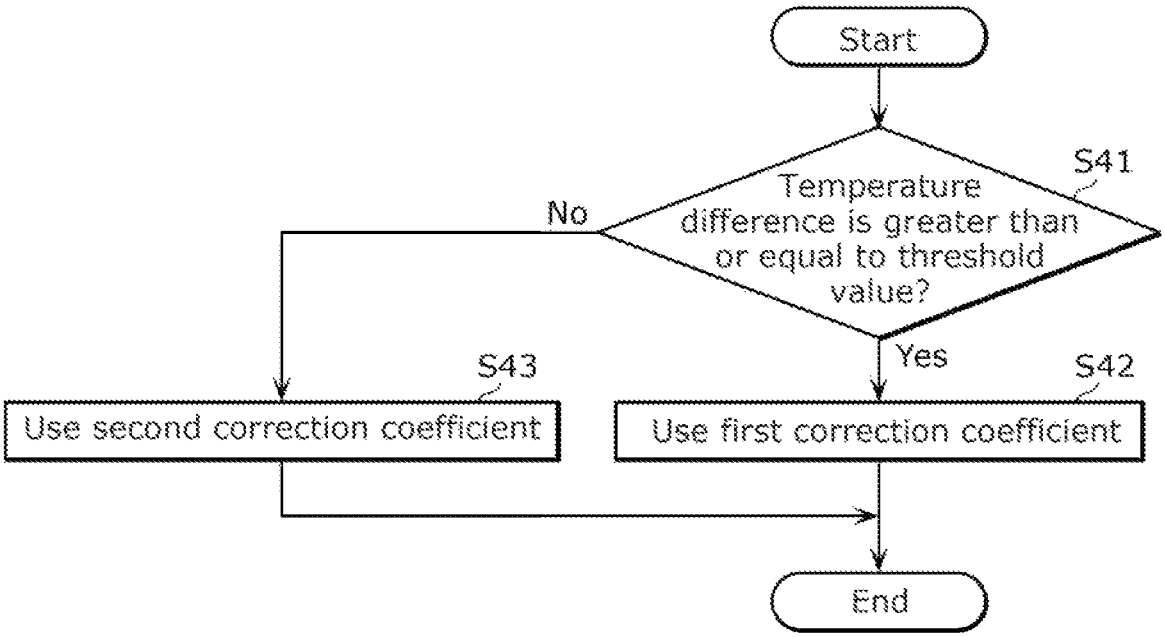
FIG. 6 is a flowchart of a correction coefficient determining operation of example 2.

Also, the correction coefficient may be determined according to the difference between the temperature of space 56 at the second timing and the temperature of space 56 at the first timing. FIG. 6 is a flowchart of a correction coefficient determining operation of example 2 performed in this case.

Filter coefficient updater 17 stores the temperature of space 56 at the second timing in storage 18, and determines, at the first timing, whether the difference between the temperature of space 56 at the second timing and the temperature of space 56 at the first timing (temperature difference) is greater than or equal to a threshold value (S41). Filter coefficient updater 17 can monitor the temperature of space 56 by, for example, acquiring a signal that indicates the temperature of space 56 output by automobile controller 55 as an automobile state signal via automobile state signal input terminal 14.

If it is determined that the difference between the temperature of space 56 at the second timing and the temperature of space 56 at the first timing is greater than or equal to the threshold value (Yes in S41), filter coefficient updater 17 corrects the first coefficient by using a first correction coefficient (S42). On the other hand, if it is determined that the difference between the temperature of space 56 at the second timing and the temperature of space 56 at the first timing is less than the threshold value (No in S41), filter coefficient updater 17 corrects the first coefficient by using a second correction coefficient that is greater than the first correction coefficient (S43). The first correction coefficient and the second correction coefficient are both values that are greater than 0 and less than 1.

As described above, filter coefficient updater 17 determines the correction coefficient to a smaller value as the difference between the temperature of space 56 at the second timing and the temperature of space 56 at the first timing is larger. The fact that the difference between the temperature of space 56 at the second timing and the temperature of space 56 at the first timing is large means that the state of automobile 50 varies significantly. Accordingly, with active noise reduction device 10, by determining the correction coefficient to a smaller value as the difference between the temperature of space 56 at the second timing and the temperature of space 56 at the first timing is larger, it is possible to prevent cancelling sound N1 from being transformed into an abnormal sound.

In the examples shown in FIGS. 5 and 6, filter coefficient updater 17 changes the value of the correction coefficient in two stages, but the value of the correction coefficient may be finely changed in three or more stages by using a plurality of different threshold values. For example, by storing, in storage 18, a calculation equation that indicates the relationship between elapsed time and correction coefficient or table information that indicates the relationship between elapsed time and correction coefficient, filter coefficient updater 17 can finely determine the correction coefficient by using the calculation equation or the table information stored in storage 18. Likewise, for example, by storing, in storage 18, a calculation equation that indicates the relationship between temperature difference and correction coefficient or table information that indicates the relationship between temperature difference and correction coefficient, filter coefficient updater 17 can finely determine the correction coefficient by using the calculation equation or the table information stored in storage 18.

Also, the correction coefficient may be determined according to the difference between a reference temperature (for example, a temperature of 20° C. or more and 25° C. or less) and the temperature of space 56 at the first timing. In this case, the correction value (correction amount) per unit temperature (for example, 1° C.) may be changed based on whether the temperature of space 56 at the first timing is lower or higher than the reference temperature. The reference temperature is, for example, the temperature of space 56 when measuring the acoustic sound transfer function. In general, when the temperature changes on the minus side relative to the reference temperature, the acoustic sound transfer characteristics vary more significantly than when the temperature changes on the plus side relative to reference temperature. When the temperature of space 56 at the first timing is lower than the reference temperature, by setting the correction amount to be larger than that when the temperature of space 56 at the first timing is higher than the reference temperature, it is possible to implement a correction according to the variation of the acoustic sound transfer characteristics.

Also, filter coefficient updater 17 may determine whether to continuously use the first coefficient or use the corrected first coefficient according to the length of the period from the second timing to the first timing. Likewise, filter coefficient updater 17 may determine whether to continuously use the first coefficient or use the corrected first coefficient according to the difference between the temperature of space 56 at the second timing and the temperature of space 56 at the first timing.

[Operation Mode]

In the case where active noise reduction device 10 is configured to be operable in a plurality of operation modes, filter coefficient updater 17 may store coefficient W that is used as the initial value for each operation mode. The plurality of operation modes include: for example, an operation mode in which the noise near one seat in space 56 is reduced; an operation mode in which the noise near each of four seats in space 56 is reduced; and the like. In the case where the noise near each of a plurality of seats in space 56 is reduced, error signal source 53 is provided for each of the plurality of seats. The following description will be given by defining two operation modes out of the plurality of operation modes as a first operation mode and a second operation mode.

For example, in response to acquiring a stop signal while active noise reduction device 10 is operating in the first operation mode, filter coefficient updater 17 stores adaptive filter coefficient W in nonvolatile storage area 18*b* as a first coefficient, adaptive filter coefficient W being calculated by filter coefficient updater 17 at the most recent timing (or in other words, the timing at which active noise reduction device 10 was operating in the first operation mode). On the other hand, in response to acquiring a stop signal while active noise reduction device 10 is operating in the second operation mode, filter coefficient updater 17 stores adaptive filter coefficient W in nonvolatile storage area 18*b* as a second coefficient separately from the first coefficient, adaptive filter coefficient W being calculated by filter coefficient updater 17 at the most recent timing (or in other words, the timing at which active noise reduction device 10 was operating in the second operation mode).

Figure 7:
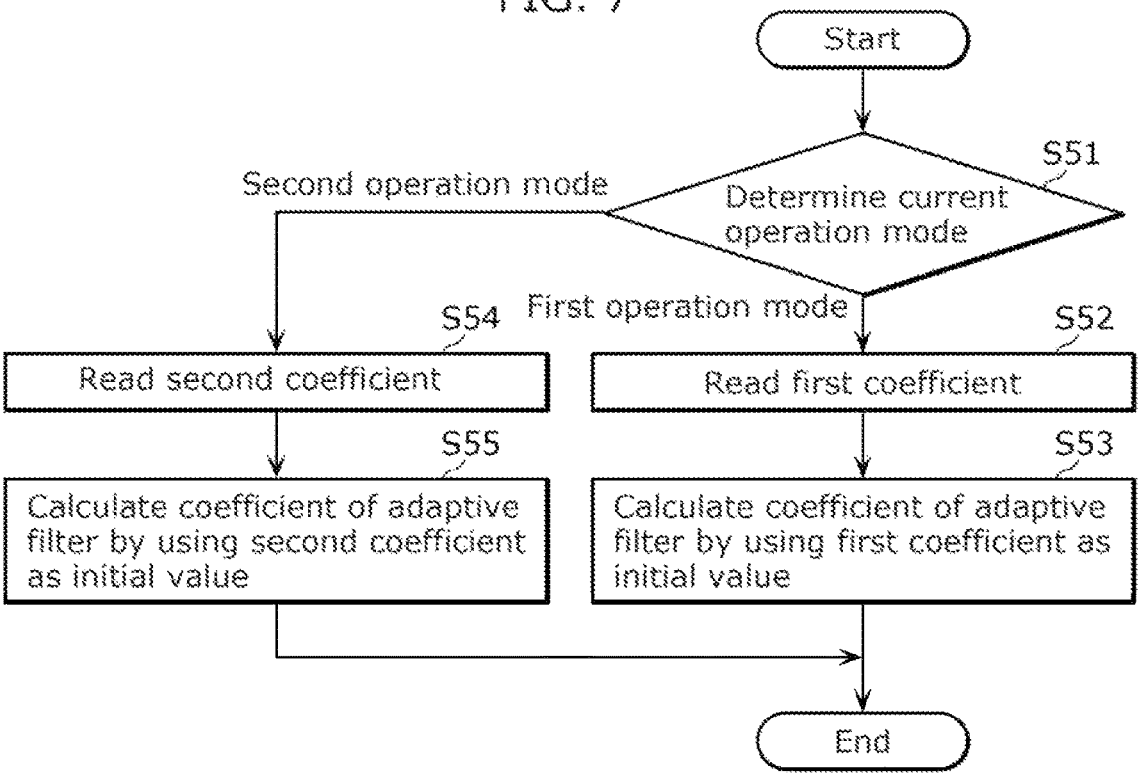
FIG. 7 is a flowchart of an operation for selecting a coefficient according to an operation mode.

In the manner described above, as long as coefficient W that is used as the initial value is stored for each operation mode, by selecting coefficient W according to the current operation mode, active noise reduction device 10 can prevent cancelling sound N1 from being transformed into an abnormal sound. FIG. 7 is a flowchart of an operation for selecting coefficient W according to the operation mode.

Filter coefficient updater 17 determines whether the current operation mode is in the first operation mode or in the second operation mode when the output of cancelling sound N1 is started (S51). The current operation mode can be determined by using, for example, a flag or the like stored in storage 18.

If it is determined that the current operation mode is the first operation mode (first operation mode in S51), filter coefficient updater 17 reads the first coefficient from nonvolatile storage area 18*b* (S52), and calculates adaptive filter coefficient W based on the update equation in which the read first coefficient is used as the initial value (S53).

On the other hand, if it is determined that the current operation mode is the second operation mode (second operation mode in S51), filter coefficient updater 17 reads the second coefficient from nonvolatile storage area 18*b* (S54), and calculates adaptive filter coefficient W based on the update equation in which the read second coefficient is used as the initial value (S55).

In the manner described above, filter coefficient updater 17 uses coefficient W that corresponds to the current operation mode as the initial value of the update equation. By doing so, active noise reduction device 10 can shorten the time required to obtain the effect of reducing noise NO by using cancelling sound N1 while preventing cancelling sound N1 from being transformed into an abnormal sound.

[Variation]

In the embodiment given above, active noise reduction device 10 is configured such that, in response to acquiring a stop signal from automobile controller 55, active noise reduction device 10 is transitioned to a power off state (shut down state), and the supply of power to storage 18 is interrupted while active noise reduction device 10 is in the power off state. In step S23 shown in the flowchart in FIG. 4 described above, on the assumption that the supply of power to storage 18 is to be interrupted, adaptive filter coefficient W that was calculated at the most recent timing and stored in volatile storage area 18*a* is read, and stored in nonvolatile storage area 18*b* as the first coefficient.

However, active noise reduction device 10 may be transitioned to a sleep state instead of being transitioned to the power off state in response to acquiring the stop signal. While active noise reduction device 10 is in the sleep state, the supply of power to storage 18 is maintained, and thus adaptive filter coefficient W that was calculated at the most recent timing and stored in volatile storage area 18*a* can be used as the first coefficient. That is, the first coefficient may be stored in volatile storage area 18*a*.

Active noise reduction device 10 configured as described above may omit the processing of reading adaptive filter coefficient W stored in volatile storage area 18*a* and storing adaptive filter coefficient W in nonvolatile storage area 18*b*. As a result, active noise reduction device 10 can reduce the storage capacity of storage 18, and shorten the end time and the activation time.

Figure 8:
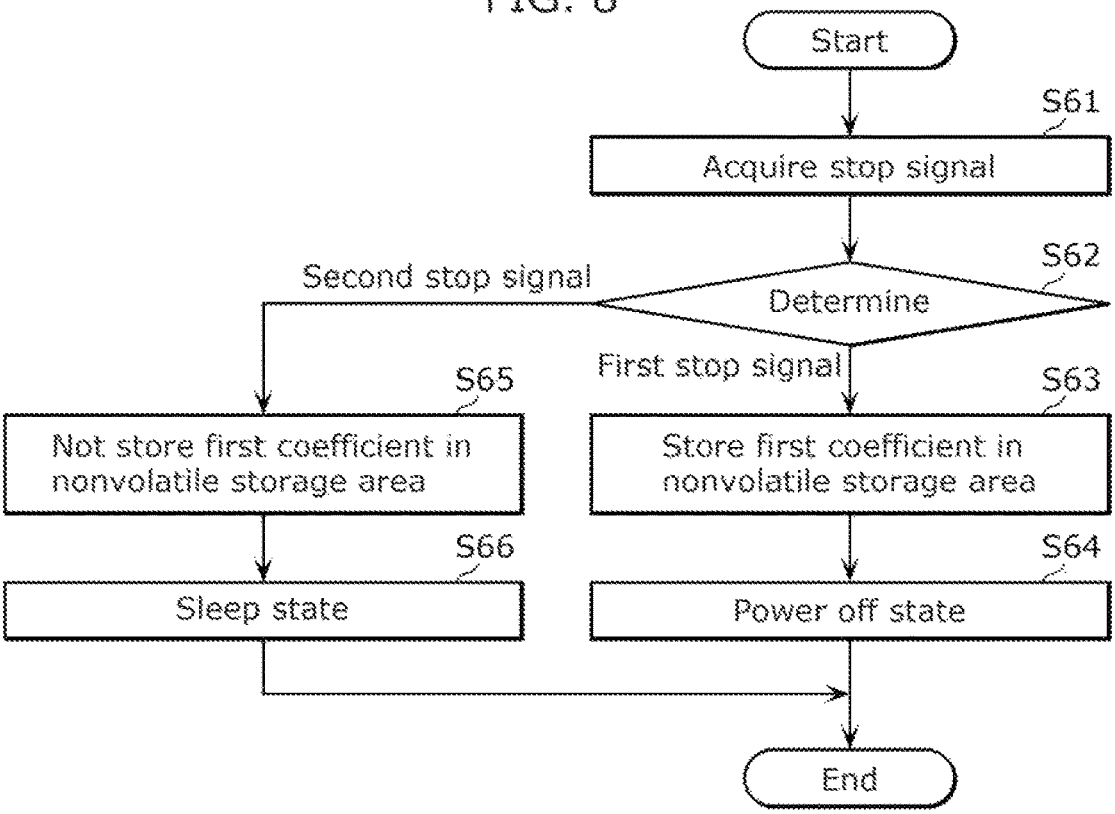
FIG. 8 is a flowchart of an operation for selecting whether to store a first coefficient in a nonvolatile storage area.

Also, a case may be considered where the sleep state cannot be maintained as a result of the supply of power being forcibly interrupted, such as when replacing the battery of automobile 50. In this case, by automobile controller 55 selectively outputting two different types of stop signals (a first stop signal and a second stop signal) that indicate whether the supply of power is to be interrupted, filter coefficient updater 17 can select whether to store (move) the first coefficient in (to) nonvolatile storage area 18*b*. FIG. 8 is a flowchart of an operation for selecting whether to store (move) the first coefficient in (to) nonvolatile storage area 18*b*.

Filter coefficient updater 17 acquires a stop signal from automobile controller 55 via automobile state signal input terminal 14 (S61). Filter coefficient updater 17 determines whether the acquired stop signal is a first stop signal that indicates the supply of power to active noise reduction device 10 is to be interrupted or a second stop signal that indicates the supply of power to active noise reduction device 10 is to be maintained (S62).

If it is determined that the stop signal acquired in step S61 is the first stop signal (first stop signal in S62), filter coefficient updater 17 reads adaptive filter coefficient W that was calculated at the most recent timing and stored in volatile storage area 18*a*, and stores adaptive filter coefficient W in nonvolatile storage area 18*b* as a first coefficient (S63). After that, active noise reduction device 10 is transitioned to a power off state (S64).

On the other hand, if it is determined that the stop signal acquired in step S61 is the second stop signal (second stop signal in S62), filter coefficient updater 17 does not store, in nonvolatile storage area 18*b*, adaptive filter coefficient W that was calculated at the most recent timing and stored in volatile storage area 18*a* (S65). After that, active noise reduction device 10 is transitioned to a sleep state (S66). In this case, adaptive filter coefficient W that was calculated at the most recent timing and stored in volatile storage area 18*a* is continuously used as the first coefficient.

As described above, basically, when filter coefficient updater 17 receives a notification of interruption of the supply of power to active noise reduction device 10 (or in other words, when filter coefficient updater 17 acquires a first stop signal) while storing the first coefficient in nonvolatile storage area 18*b* at the second timing, filter coefficient updater 17 stores the first coefficient in volatile storage area 18*a* at the second timing. By doing so, even if the first coefficient stored in volatile storage area 18*a* is deleted due to the interruption of the supply of power, active noise reduction device 10 can shorten the time required to obtain the effect of reducing noise NO by using cancelling sound N1.

Filter coefficient updater 17 may be configured to autonomously detect an interruption of the supply of power to active noise reduction device 10 and store the first coefficient in nonvolatile storage area 18*b* at the second timing. As the method for detecting an interruption of the supply of power, any known method may be used.

[Other Variations]

In the embodiment given above, active noise reduction device 10 uses filter coefficient W calculated by active noise reduction device 10 in the past as the initial value of the update equation, but the initial value may be a value other than 0 determined in advance by a designer or the like.

For example, the initial value may be a value calculated in advance by a designer or the like through a simulation. Alternatively, filter coefficients W of a plurality of automobiles 50 may be calculated by actually driving the plurality of automobiles 50, and the average value of the plurality of calculated filter coefficients may be stored in storage 18 in advance as the initial value. When the initial value is determined through a simulation or tuning in the manner as described above, by adapting adaptive filter 15 under conditions where the roadway condition, the automobile speed, and the like are different, various bands are excited, and thus the noise reduction performance can be improved under various driving conditions.

Also, in the embodiment given above, adaptive filter coefficient W is stored in storage 18 at the timing at which the engine is turned off, but the present disclosure is not limited to this timing. For example, adaptive filter coefficient W may be updated at the time of shipping inspection performed when automobile 50 is shipped, and coefficient W at this time may be stored as the initial value. At the time of shipping inspection, by driving automobile 50 and adapting adaptive filter 15 under conditions (moving conditions) where the roadway condition, the automobile speed, and the like are different, coefficient W in which various components are excited can be stored in storage 18.

Also, adaptive filter coefficient W may be updated at the time of transportation for delivery of automobile 50, and coefficient W at this time may be stored in storage 18 as the initial value. The original initial value before adaptive filter coefficient W is updated is 0, but may be a value determined through a simulation or tuning as described above. By updating adaptive filter coefficient W in the manner described above before automobile 50 is delivered to its user, individual variations between automobiles can be adjusted, and the noise reduction performance can be improved.

In the case where automobile 50 is driven under an unordinary condition at the time of shipping inspection or the like (for example, in the case where automobile 50 is driven on a chassis dynamometer, or the like), when adaptive filter coefficient W calculated at the shipping inspection or the like is stored as the initial value, coefficient W is no longer a general value. To prevent this, a configuration may be used in which coefficient W calculated at the time of shipping inspection or the like is not stored in storage 18. For example, when active noise reduction device 10 is transitioned to an inspection mode, coefficient W may not be stored in storage 18 as the initial value. That is, active noise reduction device 10 may have a function of prohibiting the processing of storing coefficient W in storage 18 as the initial value. The original initial value at this time is 0, but may be a value determined through a simulation or tuning in the manner as described above.

Advantageous Effects, Etc.

As described above, active noise reduction device 10 includes: reference signal input terminal 11 to which a reference signal that has a correlation with noise NO in space 56 of automobile 50 is input, the reference signal being output by reference signal source 51 attached to automobile 50; adaptive filter 15 that generates a cancelling signal by applying an adaptive filter to the reference signal that is input to reference signal input terminal 11, the cancelling signal being used to output cancelling sound N1 for reducing noise NO; and filter coefficient updater 17 that calculates adaptive filter coefficient W based on a predetermined update equation. At a first timing at which the output of cancelling sound N1 is started, filter coefficient updater 17 uses a first coefficient as an initial value of the update equation, the first coefficient being adaptive filter coefficient W calculated by filter coefficient updater 17 at a second timing that is prior to the first timing.

Active noise reduction device 10 configured as described above can shorten the time required to obtain the effect of reducing noise NO by using cancelling sound N1.

Also, for example, the second timing is before active noise reduction device 10 is powered off such as when the ignition power supply of automobile 50 is turned off, and the first timing is immediately after the second timing, and is a timing at which active noise reduction device 10 of automobile 50 is turned on.

With active noise reduction device 10 configured as described above, at the time when automobile 50 resumes moving, by using adaptive filter coefficient W used until automobile 50 resumes moving as the initial value of the update equation, it is possible to shorten the time required to obtain the effect of reducing noise NO by using cancelling sound N1.

Also, for example, the second timing is before active noise reduction device 10 is shipped.

With active noise reduction device 10 configured as described above, by using adaptive filter coefficient W tuned before shipping as the initial value of the update equation, it is possible to shorten the time required to obtain the effect of reducing noise NO by using cancelling sound N1.

Also, for example, the second timing is immediately after automobile 50 is driven (moved) under a plurality of different driving conditions (moving conditions).

With active noise reduction device 10 configured as described above, by using adaptive filter coefficient W in which various components are excited before shipping as the initial value of the update equation, it is possible to shorten the time required to obtain the effect of reducing noise NO by using cancelling sound N1.

Also, for example, active noise reduction device 10 further includes storage 18 that stores the first coefficient.

Active noise reduction device 10 has a function of prohibiting the processing of storing the first coefficient in storage 18.

With active noise reduction device 10 configured as described above, it is possible to prevent adaptive filter coefficient W calculated when automobile 50 is driven under an unordinary condition from being stored as the initial value.

Also, for example, active noise reduction device 10 selectively operates in either one of a first operation mode or a second operation mode. At a first timing at which the output of cancelling sound N1 in the first operation mode is started, filter coefficient updater 17 uses a first coefficient as the initial value of the update equation. Also, at a timing at which the output of cancelling sound N1 in the second operation mode is started, filter coefficient updater 17 uses a second coefficient that is different from the first coefficient and is adaptive filter coefficient W calculated by filter coefficient updater 17 prior to the timing at which the output of cancelling sound N1 in the second operation mode is started, as the initial value of the update equation.

With active noise reduction device 10 configured as described above, by using coefficient W that corresponds to the current operation mode as the initial value of the update equation, it is possible to shorten the time required to obtain the effect of reducing noise NO by using cancelling sound N1.

Also, for example, at the first timing, filter coefficient updater 17 uses, instead of the first coefficient, a corrected first coefficient obtained by multiplying the first coefficient by a correction coefficient that is greater than 0 and is less than 1 as the initial value of the update equation.

With active noise reduction device 10 configured as described above, it is possible to shorten the time required to obtain the effect of reducing noise NO by using cancelling sound N1, while preventing cancelling sound N1 from being transformed into an abnormal sound.

Also, for example, the correction coefficient takes a smaller value as the length of the period from the second timing to the first timing is longer.

With active noise reduction device 10 configured as described above, it is possible to prevent cancelling sound N1 from being transformed into an abnormal sound based on the length of the period from the second timing to the first timing.

Also, for example, the correction coefficient takes a smaller value as the difference between the temperature of space 56 at the second timing and the temperature of space 56 at the first timing is larger.

With active noise reduction device 10 configured as described above, it is possible to prevent cancelling sound N1 from being transformed into an abnormal sound based on the difference between the temperature of space 56 at the second timing and the temperature of space 56 at the first timing.

Also, for example, filter coefficient updater 17 stores the first coefficient in nonvolatile storage area 18*b* at the second timing, reads the first coefficient stored in nonvolatile storage area 18*b* at the first timing, and uses the first coefficient as the initial value of the update equation. Nonvolatile storage area 18*b* is an example of a nonvolatile storage.

With active noise reduction device 10 configured as described above, even when the supply of power to active noise reduction device 10 is interrupted at a timing between the second timing and the first timing, it is possible to shorten the time required to obtain the effect of reducing noise NO by using cancelling sound N1.

Also, for example, filter coefficient updater 17 stores the first coefficient in volatile storage area 18*a* at the second timing, reads the first coefficient stored in volatile storage area 18*a* at the first timing, and uses the first coefficient as the initial value of the update equation. Volatile storage area 18*a* is an example of a volatile storage.

With active noise reduction device 10 configured as described above, it is possible to omit the processing of reading adaptive filter coefficient W stored in volatile storage area 18*a* and storing adaptive filter coefficient W in nonvolatile storage area 18*b*.

Also, filter coefficient updater 17 stores the first coefficient in nonvolatile storage area 18*b* at the second timing, for example, when a notification of interruption of the supply of power to active noise reduction device 10 is received, or when an interruption of the supply of power is detected.

With active noise reduction device 10 configured as described above, even when the first coefficient stored in volatile storage area 18*a* is deleted due to the interruption of the supply of power, it is possible to shorten the time required to obtain the effect of reducing noise NO by using cancelling sound N1.

Also, automobile 50 includes active noise reduction device 10 and reference signal source 51.

With automobile 50 configured as described above, it is possible to shorten the time required to obtain the effect of reducing noise NO by using cancelling sound N1.

An active noise reduction method executed by active noise reduction device 10 includes: generating a cancelling signal by applying an adaptive filter to a reference signal that has a correlation with noise NO in space 56 of automobile 50 and is output by reference signal source 51 attached to automobile 50, the cancelling signal being used to output cancelling sound N1 for reducing noise NO; and calculating a coefficient of the adaptive filter based on a predetermined update equation. The calculating includes, at a first timing at which the output of cancelling sound N1 is started, using a first coefficient as an initial value of the update equation, the first coefficient being the coefficient of the adaptive filter calculated by active noise reduction device 10 at a second timing that is prior to the first timing.

With the active noise reduction method as described above, it is possible to shorten the time required to obtain the effect of reducing noise NO by using cancelling sound N1.

Other Embodiments

The embodiment has been described above, but the present disclosure is not limited to the above-described embodiment.

For example, the active noise reduction device according to the embodiment given above may be incorporated in a vehicle other than an automobile. The vehicle may be, for example, an aircraft or a vessel. Also, the present disclosure may be implemented as a vehicle other than an automobile as described above.

Also, the configuration of the active noise reduction device according to the embodiment given above is an example. For example, the active noise reduction device may include a structural element such as a D/A converter, a filter, a power amplifier, or an A/D converter.

Also, in the embodiment given above, the reference signal inputter, the error signal inputter, and the cancelling signal outputter are described as different terminals, but may be configured as a single terminal. For example, by using a digital communication standard with which devices such as the reference signal source, the error signal source, and the cancelling sound source can be connected in a chain, the reference signal inputter, the error signal inputter, and the cancelling signal outputter can be implemented by using a single terminal.

Also, the processing performed by the active noise reduction device according to the embodiment given above is an example. For example, a portion of the digital signal processing described in the embodiment given above may be implemented by using analog signal processing.

Also, for example, in the embodiment given above, the processing performed by a specific processor may be performed by another processor. Also, the order in which a plurality of processing operations are performed may be changed, and a plurality of processing operations may be performed in parallel.

Also, in the embodiment given above, the structural elements may be implemented by executing a software program suitable for the structural elements. The structural elements may be implemented by a program executor such as a CPU or a processor reading a software program recorded in a recording medium such a hard disk or a semiconductor memory and executing the software program.

Also, in the embodiment given above, the structural elements may be implemented by using hardware. For example, the structural elements may be circuits (or integrated circuits). These circuits may constitute one circuit as a whole, or may be separate circuits. Also, each of these circuits may be a general-purpose circuit or a dedicated circuit.

Also, the structural elements may be circuits (or integrated circuits). These circuits may constitute one circuit as a whole, or may be separate circuits. Also, each of these circuits may be a general-purpose circuit or a dedicated circuit.

Also, general and specific aspects of the present disclosure may be implemented by using a system, a device, a method, an integrated circuit, a computer program, or a computer-readable recording medium such as a CD-ROM. Alternatively, general and specific aspects of the present disclosure may be implemented by using any combination of systems, devices, methods, integrated circuits, computer programs, and computer-readable recording media.

For example, the present disclosure may be implemented as an active noise reduction method that is executed by an active noise reduction device (a computer or a DSP), or may be implemented as a program for causing a computer or a DSP to execute the active noise reduction method. Also, the present disclosure may be implemented as a computer-readable non-transitory recording medium in which the program is recorded. Also, the present disclosure may be implemented as a vehicle (for example, an automobile) or an active noise reduction system. The vehicle or the active noise reduction system described above includes, for example, the active noise reduction device and the reference signal source according to the embodiment given above.

The present disclosure also encompasses other embodiments obtained by making various modifications that can be conceived by a person having ordinary skill in the art to the above embodiments as well as embodiments implemented by any combination of the structural elements and the functions of the above embodiments without departing from the scope of the present invention.

While various embodiments have been described herein above, it is to be appreciated that various changes in form and detail may be made without departing from the spirit and scope of the present disclosure as presently or hereafter claimed.

Further Information about Technical Background to this Application

The disclosure of the following patent application including specification, drawings and claims is incorporated herein by reference in its entirety: Japanese Patent Application No. 2021-4545 filed on Jan. 14, 2021.

INDUSTRIAL APPLICABILITY

The active noise reduction device according to the present disclosure is useful as a device that can reduce noise in, for example, an automobile cabin.

The invention claimed is:

1. An active noise reduction device, comprising:

a reference signal inputter to which a reference signal that has a correlation with noise in a space in a vehicle is input, the reference signal being output by a reference signal source attached to the vehicle;

an adaptive filter that is applied to the reference signal that is input to the reference signal inputter to generate a cancelling signal, the cancelling signal being used to output a cancelling sound for reducing the noise; and a filter coefficient updater that calculates a coefficient of the adaptive filter based on a predetermined update equation, wherein, at a first timing at which the output of the cancelling sound is started, the filter coefficient updater reads a first coefficient as an initial value of the predetermined update equation, the first coefficient being the coefficient of the adaptive filter calculated by the filter coefficient updater at a second timing that is prior to the first timing, wherein, at the first timing, the filter coefficient updater uses a corrected first coefficient obtained by multiplying the first coefficient by a correction coefficient that is greater than 0 and less than 1 as the initial value of the predetermined update equation, instead of using the first coefficient, and wherein the correction coefficient, which is greater than 0 and less than 1, is determined according to a length of a period from the second timing to the first timing.

2. The active noise reduction device according to claim 1, wherein the second timing is a timing at which an ignition power supply of the vehicle is turned off, and the first timing is immediately after the second timing, and is a timing at which the active noise reduction device is turned on.

3. The active noise reduction device according to claim 1, wherein the second timing is before the active noise reduction device is shipped.

4. The active noise reduction device according to claim 3, wherein the second timing is immediately after the vehicle is moved under a plurality of different moving conditions.

5. The active noise reduction device according to claim 3, further comprising a storage that stores the first coefficient, wherein the active noise reduction device has a function of prohibiting processing of storing the first coefficient in the storage.

6. The active noise reduction device according to claim 1, wherein the active noise reduction device selectively operates in either a first operation mode or a second operation mode, and the filter coefficient updater uses the first coefficient as the initial value of the update equation at the first timing at which the output of the cancelling sound in the first operation mode is started, and uses a second coefficient as the initial value of the update equation at a timing at which the output of the cancelling sound in the second operation mode is started, the second coefficient being a coefficient that is different from the first coefficient and is the coefficient of the adaptive filter calculated by the filter coefficient updater prior to the timing at which the output of the cancelling sound in the second operation mode is started.

7. The active noise reduction device according to claim 1, wherein the correction coefficient decreases in value as the length of the period from the second timing to the first timing increases in length.

8. The active noise reduction device according to claim 1, wherein the filter coefficient updater stores the first coefficient in a nonvolatile storage at the second timing, and reads the first coefficient stored in the nonvolatile storage as the initial value of the update equation at the first timing.

9. The active noise reduction device according to claim 1, wherein the filter coefficient updater stores the first coefficient in a volatile storage at the second timing, and reads the first coefficient stored in the volatile storage as the initial value of the update equation at the first timing.

10. The active noise reduction device according to claim 9, wherein the filter coefficient updater stores the first coefficient in a nonvolatile storage at the second timing when a notification of interruption of a supply of power to the active noise reduction device is received or when an interruption of the supply of power is detected.

11. A vehicle comprising:

the active noise reduction device according to claim 1; and the reference signal source.

12. The active noise reduction device according to claim 1, wherein the filter coefficient updater determines whether the length of the period from the second timing to the first timing is greater than or equal to a threshold value, the filter coefficient updater uses a first correction coefficient as the correction coefficient in response to the length of the period being greater than or equal to the threshold value, and the filter coefficient updater uses a second correction coefficient, different than the first correction coefficient, as the correction coefficient in response to the length of the period being less the threshold value.

13. The active noise reduction device according to claim 12, wherein the second correction coefficient is greater than the first correction coefficient.

14. The active noise reduction device according to claim 1, wherein the filter coefficient updater determines whether the length of the period from the second timing to the first timing is greater than or equal to a plurality of different threshold values, and the filter coefficient updater determines the correction coefficient in three or more stages, from among a plurality of correction coefficients, depending on whether the length of the period is greater than or equal to the plurality of different threshold values.

15. An active noise reduction device, comprising:

a reference signal inputter to which a reference signal that has a correlation with noise in a space in a vehicle is input, the reference signal being output by a reference signal source attached to the vehicle;

an adaptive filter that is applied to the reference signal that is input to the reference signal inputter to generate a cancelling signal, the cancelling signal being used to output a cancelling sound for reducing the noise; and a filter coefficient updater that calculates a coefficient of the adaptive filter based on a predetermined update equation, wherein, at a first timing at which the output of the cancelling sound is started, the filter coefficient updater reads a first coefficient as an initial value of the predetermined update equation, the first coefficient being the coefficient of the adaptive filter calculated by the filter coefficient updater at a second timing that is prior to the first timing, wherein, at the first timing, the filter coefficient updater uses a corrected first coefficient obtained by multiplying the first coefficient by a correction coefficient that is greater than 0 and less than 1 as the initial value of the predetermined update equation, instead of using the first coefficient, and wherein the correction coefficient decreases in value as a difference between a temperature of the space at the second timing and a temperature of the space at the first timing increases in value.

16. The active noise reduction device according to claim 15, wherein the filter coefficient updater determines whether the difference between the temperature of the space in the vehicle at the second timing and the temperature of the space in the vehicle at the first timing is greater than or equal to a threshold value, the filter coefficient updater uses a first correction coefficient as the correction coefficient in response to the difference being greater than or equal to the threshold value, and the filter coefficient updater uses a second correction coefficient, different than the first correction coefficient, as the correction coefficient in response to the difference being less the threshold value.

17. The active noise reduction device according to claim 16, wherein the second correction coefficient is greater than the first correction coefficient.

18. An active noise reduction method executed by an active noise reduction device, the active noise reduction method comprising:

generating a cancelling signal by applying an adaptive filter to a reference signal, the reference signal having a correlation with noise in a space in a vehicle and being output by a reference signal source attached to the vehicle, the cancelling signal being used to output a cancelling sound for reducing the noise; and calculating a coefficient of the adaptive filter based on a predetermined update equation, wherein the calculating includes, at a first timing at which the output of the cancelling sound is started, reading a first coefficient as an initial value of the predetermined update equation, the first coefficient being the coefficient of the adaptive filter calculated by the active noise reduction device at a second timing that is prior to the first timing, wherein the calculating further includes, at the first timing, multiplying the first coefficient by a correction coefficient that is greater than 0 and less than 1 to obtain a corrected first coefficient, and using the corrected first coefficient as the initial value of the predetermined update equation instead of the first coefficient, and wherein the correction coefficient, which is greater than 0 and less than 1, is determined according to a length of a period from the second timing to the first timing.

* * * * *